United States Patent [19]

Sachse

[11] Patent Number: 4,497,016

[45] Date of Patent: Jan. 29, 1985

[54] LIGHTING DEVICE

[75] Inventor: Christian Sachse, Hildesheim, Fed. Rep. of Germany

[73] Assignee: Electrotechnik-Apparatebau Peter Schmitz, Fed. Rep. of Germany

[21] Appl. No.: 554,636

[22] Filed: Nov. 23, 1983

[30] Foreign Application Priority Data

Nov. 25, 1982 [DE] Fed. Rep. of Germany ... 8233139[U]

[51] Int. Cl.[3] ..... F21V 29/00

[52] U.S. Cl. ..... 362/294; 362/310; 362/373

[58] Field of Search ..... 362/294, 373, 310

[56] References Cited

U.S. PATENT DOCUMENTS 2,583,417 1/1952 Eitel et al. ..... 362/373 X 4,414,615 11/1983 Szeker et al. ..... 362/373 X 4,450,512 11/1984 Kristofek ..... 362/373 X

*Primary Examiner*—Stephen J. Lechert, Jr.

[57] ABSTRACT

A high power lighting device comprises a low voltage lamp which is driven from a mains supply via a toroidal transformer. The toroidal transformer 32 is housed radially outside of the reflector 20 of the low voltage lamp 10 in an annular chamber defined by a portion of a housing 12 and by a partition wall 46. The partition wall 46 is spaced from the low voltage lamp 10 and from the toroidal transformer 32 so as to form two coaxial airflow channels 48 and 50. Heat radiated from the low voltage lamp 10 is picked up by the partition wall 46 and air entering through suitably disposed openings at the front side of the lighting device flows through the two air channels 48 and 50, over both sides of the partition wall 46, and leaves the housing through openings adjacent the threaded base 18. The threaded base 18 and the shape of the lighting device make it possible for the lighting device to be screwed into normal threaded lamp sockets used for pressed glass type lamps.

13 Claims, 1 Drawing Figure

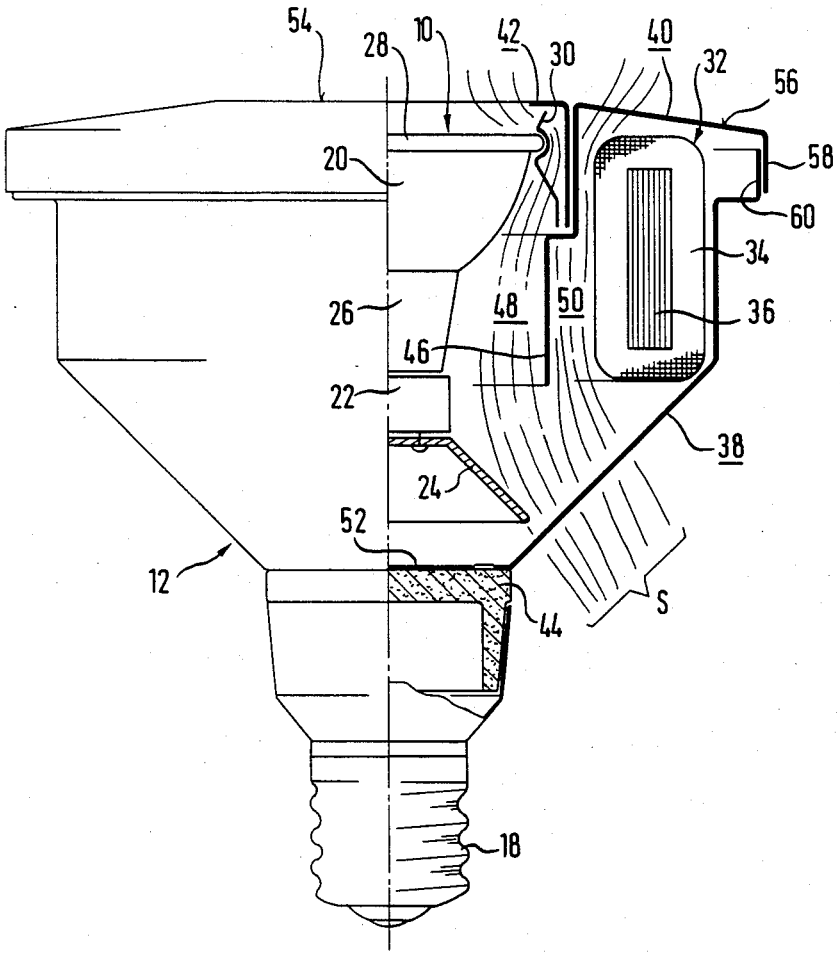
54
28
10
42
30
40
32
56
58
60
20
34
26
48
50
36
46
22
38
24
52
12
44
S
18

LIGHTING DEVICE

The invention relates to a lighting device comprising a low voltage lamp including a reflector, and a toroidal transformer which delivers the feed voltage for the low voltage lamp and which is housed, together with the individual parts of the low voltage lamp, in a housing for the lighting device.

In a known lighting device of this kind (German Gebrauchsmuster No. 73 42 342) the low voltage lamp and the toroidal transformer are housed in a cylindrical housing, with the toroidal transformer being arranged around the lamp socket which adjoins the reflector of the low voltage lamp. The outer diameter of the toroidal transformer is the same as the diameter of the reflector and corresponds approximately to the internal diameter of the cylindrical housing.

In this known lighting device the dissipation of heat from the reflector of the low voltage lamp is impaired by the toroidal transformer which is arranged directly behind the reflector. As a result of the lack of or reduced airflow in the housing a build-up of heat readily occurs which can impair the function of the lighting device. It is in particular disadvantageous that the heat originating from the reflector is radiated directly to the toroidal transformer which in operation can have a disturbing effect on the transformer. Furthermore, the known lighting device must always be connected with the mains power supply via cables or connection lines. In this respect it is particularly disadvantageous that the stands, lamp sockets, or the like, of other lighting devices or lamps cannot be straightforwardly used for this known lighting device.

The problem underlying the invention is to provide a lighting device of the initially named kind which can be used without problems, in particular in places where customary, heavy, pressed glass lamps are also used, and for which optimum heat dissipation is always ensured, with optimum protection of the toroidal transformer from the radiant heat originating from the low voltage lamp while avoiding any form of heat build-up in the housing.

This problem is solved, in accordance with the invention, in that the housing generally has the contour of a pressed glass lamp with a normal base mounted thereon; in the the toroidal transformer is arranged around the reflector of the low voltage lamp in the light exit side region of the housing, which is provided with airflow openings; and in that a substantially cylindrical partition wall is provided between the toroidal transformer and the low voltage lamp, with the partition wall being spaced from both the low voltage lamp and the toroidal transformer and forming two air channels or a double chimney.

As a result of this construction the toroidal transformer is protected in an extremely reliable manner from being seriously affected by the heat radiated from the low voltage lamp, and reliable cooling of the low voltage lamp arranged in the housing is ensured, while avoiding any form of heat build-up in the housing. I.e. ideal heat dissipation is always present. Having regard to the different possibilities of using the lighting device it is of particular advantage that is can, amongst other things, be used without problem anywhere where customary, heavy, pressed glass lamps are used. For this purpose the lighting device merely needs to be screwed into the lamp socket already provided for the pressed glass lamps. Additional measures for connecting the lighting device to the mains power supply are not required. A type of double chimney is provided by the partition wall arranged between the toroidal transformer and the low voltage lamp. Radiant heat originating from the low voltage lamp, for example a halogen lamp, is picked up by the partition wall or by the wall of the chimney and this wall is cooled on both sides by airflow. The toroidal transformer is in this way protected by an air cushion.

As a lighting device of this kind is generally directed downwardly, rather than upwardly, the toroidal transformer is located in the coldest region of the upwardly flowing air, because the transformer is arranged in the side region adjacent the light exit end face of the lighting device, and this results in an additional improvement in the protection of the transformer.

The airflow openings in the housing are generally all arranged such that the air flowing through both air channels, namely the air channel between the partition wall and the low voltage lamp and the air channel between the partition wall and the toroidal transformer is deflected as little as possible. The two air channels formed in the housing as a result of the partition wall can be fully separated from one another. It is however also possible for these two channels to merge, preferably in the region between the toroidal transformer and the normed base end of the lighting device.

The cylindrical partition wall advantageously extends in the axial direction of the lighting device substantially over the whole length of the toroidal transformer. In this way all the heat radiated from the reflector of the low voltage lamp in the direction of the toroidal transformer is picked up by the partition wall.

In accordance with an advantageous embodiment, in which the two air channels are intended to be of continuous construction, it is provided that the cylindrical partition wall extends from the end face of the housing at the light exit side substantially up to the oppositely disposed rear wall section of the housing, with air flow openings being provided both in the end face of the housing at the light exit side, and also in the oppositely disposed rear wall portion of the housing, in each case on both sides of the partition wall. In this case no heat can be directly transmitted from the low voltage lamp into the region which accommodates the toroidal transformer. The heat radiated from the reflector of the low voltage lamp is always picked up by the partition wall over which air flows on both sides. A cooling body, which is open towards the normed, threaded base end of the lighting device is provided at the lamp socket of the low voltage lamp, with the external surface of the cooling body forming the end portion of the radially inwardly disposed channel wall of the radially inner air channel at the normed base end of the device. In this arrangement it is preferably provided that the cooling body is of substantially truncated cone-like construction, adjoins the lamp socket of the low voltage lamp with the same diameter, and has a diameter at its end adjacent the normed base, which has the largest cross-section, which is at least as large as the diameter of the outwardly disposed normed base.

The cooling body serves on the one hand to improve the heat dissipation from the low voltage lamp to the air which is flowing around it and simultaneously to improve the guidance of the airflow which results from the temperature gradient. The fact that the cooling body adjoins the lamp socket of the low voltage lamp with the same diameter ensures that no form of air stagnation, and thus also no build-up of heat, results at this transition point. As the largest cross-section of the cooling body is at least approximately as large as the cross-section of the outwardly disposed normed base the flow of air is always deflected towards the wall region of the housing in which airflow openings are provided. Air stagnation and heat build-up in front of the normed base section of the housing wall, in which it is generally not possible to provide airflow openings, is thus prevented.

The cooling body expediently extends substantially up to the normed base region of the sidewall of the housing.

In a particularly advantageous further development of the lighting device the lamp housing of the lighting device includes a base part which carries the normed base and forms the sidewall of the housing and also a front diaphragm or bezel which forms the light exit side end face of the housing and is pushed onto the base part, and the cylindrical partition wall is formed on or attached to the front diaphragm. In this way an extremely simple construction is achieved which leads to a considerable reduction in the manufacturing costs. Additional mounting measures for the partition wall inside of the housing are not necessary with this arrangement. After removing the front diaphragm both the low voltage lamp and the toroidal transformer are readily accessible from the outside.

In a further embodiment the front diaphragm is formed of several parts and includes an annular, radially outwardly disposed, closure diaphragm, which is provided with the cylindrical partition wall, and also a rearwardly open, hollow cylindrical central part, which is inserted from the outside into the opening bounded by the partition wall.

In this arrangement the partition wall and the wall portion of the closure diaphragm at the light exit end form, together with a wall portion of the basic part of the housing which faces the partition wall, an annular space for receiving the toroidal transformer, which is accessible from the outside after removing the closure diaphragm. The central part which is inserted into the opening bounded by the partition wall lies in front of the reflector of the low voltage lamp and is generally provided with an opening for the passage of light therethrough. After removing this central part the low voltage lamp is also accessible from the outside.

It is of advantage if the central opening which is bounded by the partition wall has a portion of larger cross-section at the light exit end, which accommodates the central part, and which merges in step-like manner into a portion with a smaller cross-section which lies axially further inwardly.

In an expedient modification of the invention the annular closure diaphragm has an edge around its entire periphery which is bent into the axial direction towards the normed base and which engages around a correspondingly shaped light exit side portion of the base part. The closure diaphragm can be merely pushed over the base part or can, by way of example, be locked to the base part by rotation.

The central part is advantageously connected with the reflector via a resilient holder which engages with an outer edge of the reflector. A latched connection is possible so that, by way of example, the mounting, which is secured to the inner wall of the central part, latches with the outer edge of the reflector after insertion of the central part, or after the central part has been pushed over the reflector.

The housing expediently consists, at least in part, of apertured sheet metal.

In accordance with a preferred embodiment the low voltage lamp is a cold light mirror lamp (in German "Kaltlichtspiegellampe").

The invention will now be described in more detail with reference to a single embodiment as shown in the drawing.

The single FIGURE of the drawing shows a partly sectioned lighting device with a low voltage lamp 10 and also a toroidal transformer 32 which provides the voltage supply for the low voltage lamp. In this case the low voltage lamp is a multi-mirror cold mirror lamp. A typical value for the voltage supply of such lamps is 12 Volts with a power consumption of 50 Watts. The toroidal transformer is fed directly from the mains supply and delivers the required low voltage for the low voltage lamp.

The low voltage lamp 10, which can be a halogen lamp, includes a parabolic reflector 20 with a conical projection 26 and a lamp socket 22 arranged at the free end of the conical projection 26. All parts of the low voltage lamp 10 and also the toroidal transformer 32 are housed in a common housing 12.

The housing 12 has in general the contour of a pressed glass lamp with a threaded, normed base 18 provided at one end. That is to say the lighting housing resembles an axially compressed pear in shape, with the base of the pear being essentially flat. The threaded-type normed base is provided in countries where such threaded bases are customary, it will however be appreciated that a bayonet type fitting could also be provided if the lighting device is intended for use in countries where the bayonet type fitting is more normal. The threaded normed base 18 is secured to the end face 52 of the housing adjacent the normed base via insulation 44. The insulation 44 can for example consist of synthetic material or ceramic. The lighting device provided with a housing of this kind fits into any lamp holder which is generally provided for pressed glass lamps.

The toroidal transformer is arranged around the reflector 20 of the low voltage lamp 10 in the light exit side region of the housing 12 which is provided with airflow openings. A substantially cylindrical partition wall 46 is provided between the toroidal transformer 32 and the low voltage lamp 10. The partition wall 46 is spaced both from the low voltage lamp 10 and also from the toroidal transformer 32. Two air channels 48, 50 (or a double chimney) are formed by this cylindrical partition wall 46 in which the air flowing through the housing 12 is guided, substantially in the direction from the light exit end to the normed base end.

The cylindrical partition wall extends in the axial direction of the lighting device over the length of the toroidal transformer 32. In this way the two air channels 48, 50 which are coaxially disposed relative to one another are completely separated from one another in the region between the toroidal transformer and the part of the low voltage lamp 10 including the reflector and also the axial conical projection 26, whereas the two air channels merge with one another in the subsequent region at the normed base end. Thus the radiated heat is picked up by the partition wall or chimney wall provided between the low voltage lamp and the toroidal transformer. This wall is cooled on both sides by airflow. The toroidal transformer is thus additionally protected by an air cushion from the radiated heat. Appropriate air flow openings are provided in the housing 12 for the desired airflow S which is guided through the two air channels. For this purpose the lamp housing can consist, at least in part, of apertured metal.

A cooling body 24 which is open towards the normed base end of the lighting device is likewise provided at the lamp base of the low voltage lamp 10 housed in the housing 12 with the outer surface of the cooling body forming the end portion of the radially inwardly disposed channel wall of the radially inner air channel 48 adjacent the normed base. The cooling body 24 is of truncated cone-shape and adjoins the lamp socket 22 of the low voltage lamp 10 with the same diameter. The cross-section of the opening at the end of the cooling body 24 adjacent the normed base is somewhat larger than the cross-section of the end face 52 of the housing to which the normed base 18 is attached via the insulation 44. In this way the airflow S is deflected gently radially outwardly so that air stagnation and a build-up of heat is avoided in front of the end face 52 of the housing which generally does not have any airflow openings.

The housing 12 of the lighting device includes a base part 38 which carries the outer, normed, threaded base 18 and forms the sidewall of the housing and also a front diaphragm 40, 42 which is pushed onto the base part 38 and forms the light exit side end face 54 of the housing. The front diaphragm 42 is of two part construction and consists of an annular, radially outwardly disposed, closure diaphragm (or first bezel) 40, which includes the cylindrical partition wall 46, and also a hollow, cylindrical central part (or second bezel) 42 which is open towards the normed base end and which is inserted from the outside into the opening bounded by the partition wall 46. The central opening bounded by the partition wall 46 has a portion of greater cross-section at the light exit side which accommodates the central part 42, with this portion merging in step-like manner into a portion with an opening of smaller cross-section which lies axially further inwardly.

The annular closure diaphragm 14 has an edge 58 extending over its entire periphery which is bent over in the axial direction towards the threaded base side end. The bentover edge 58 of the closure diaphragm 50 engages around a correspondingly shaped portion 60 of the base part 38 at the light exit side. The toroidal transformer consisting of an annular core 36 and primary and secondary windings 34 is thus accommodated in an annular chamber which is bounded, on the one side, by the partition wall 46 formed by the closure diaphragm 40 and by the annular surface 56 of this diaphragm at the light exit end and, on the other side, by a portion of the sidewall of the housing formed by the base part 38 at the light exit end. The toroidal transformer 32 can expediently be attached to the sidewall of the housing formed by the base part 38. The chamber which accommodates the toroidal transformer is accessible from the outside after removal of the closure diaphragm 40. A resilient mounting 30 is secured to the inner wall of the hollow cylindrical central part 42 and this resilient mounting engages with or latches onto the external edge 28 of the reflector 20 of the low voltage lamp 10 on introduction or insertion of this central part. The light exit opening that is required is provided in the central part 42.

At least the base part 38 of the lamp housing 12 consists of apertured or perforated sheet metal. The light exit side surfaces of the closure diaphragm 40 and also of the central part 42 can also be manufactured of apertured sheet metal. The partition wall 46 formed by the closure diaphragm 40 and also the cylindrical wall of the central part 42 should however expediently be constructed as closed or uninterrupted surfaces or walls. The terminal wires of the primary winding of the transformer are attached to the conventional terminals at the threaded base, i.e. one to the metalllic threaded portion and one to the central terminal. The terminal wires of the secondary winding are connected to the bulls of the low voltage lamp.

I claim:

1. A lighting device comprising a low voltage lamp including a reflector and a lamp socket adjoining the reflector, and a toroidal transformer which delivers the feed voltage for the low voltage lamp and which is housed, together with the individual parts of the low voltage lamp, in a housing for the lighting device, characterised in that the housing (12) generally has the contour of a pressed glass lamp with a normed base (18) mounted thereon; in that the toroidal transformer (32) is arranged around the reflector (20) of the low voltage lamp (10) in the light exit side region of the housing (12), which is provided with airflow openings; and in that a substantially cylindrical partition wall (46) is provided between the toroidal transformer (32) and the low voltage lamp (10), with the partition wall (10) being spaced from both the low voltage lamp (10) and the toroidal transformer (32) and forming two air channels (48, 50) for a double chimney.

2. A lighting device in accordance with claim 1, characterised in that the cylindrical partition wall (46) extends in the axial direction of the lighting device substantially over the whole length of the toroidal transformer (32).

3. A lighting device in accordance with claim 2, characterised in that the cylindrical partition wall (46) extends from the end face of the housing (54) at the light exit side substantially up to the oppositely disposed rear wall section of the housing, with air flow openings being provided both in the end face of the housing (54) at the light exit side, and also in the oppositely disposed rear wall portion of the housing, in each case on both sides of the partition wall (46).

4. A lighting device in accordance with claim 1, characterised in that a cooling body (24) which is open towards the normed, threaded base end of the lighting device is provided at the lamp socket (22) of the low voltage lamp (10), with the external surface of the cooling body forming the end portion of the radially inwardly disposed channel wall of the radially inner air channel at the normed base end of the device.

5. A lighting device in accordance with claim 4, characterised in that the cooling body (24) is of substantially truncated cone-like construction, adjoins the lamp socket (22) of the low voltage lamp (10) with the same diameter, and has a diameter at its end adjacent the normed base which has the largest cross-section, which is at least as large as the diameter of the outwardly disposed normed base (18).

6. A lighting device in accordance with claim 4 characterised in that the cooling body (24) extends substantially up to the region of the housing sidewall adjacent the normed base.

7. A lighting device in accordance with claim 1, characterised in that the housing of the lighting device includes a base part (38) which carries the normed base

(18) and forms the sidewall of the housing and also a front diaphragm or bezel (40, 42) which forms the light exit side end face (54) of the housing and is pushed onto the base part (38); and in that the cylindrical partition wall (46) is formed on or attached to the front diaphragm (40, 42).

8. A lighting device in accordance with claim 7, characterised in that the front diaphragm is formed of several parts and includes an annular, radially outwardly disposed, closure diaphragm (40), which is provided with the cylindrical partition wall (46), and also a rearwardly open, hollow cylindrical central part (42) which is inserted from the outside into the opening bounded by the partition wall (46).

9. A lighting device in accordance with claim 8, characterised in that the central opening bounded by the partition wall (46) has a portion of larger cross-section which accommodates the central part (42) and which changes in step-like manner into an axially further inwardly disposed portion with a smaller cross-section.

10. A lighting device in accordance with claim 1, characterised in that the annular closure diaphragm (40) has an edge (58) around its entire periphery which is bent into the axial direction towards the normed base and which engages around a correspondingly shaped light exit side portion (60) of the base part (38).

11. A lighting device in accordance with claim 1, characterised in that the central part (42) is connected with the reflector (20) via a resilient holder (30) which engages with an outer edge (28) of the reflector (20).

12. A lighting device in accordance with claim 8, characterised in that the housing (12) consists at least in part of apertured sheet metal.

13. A lighting device in accordance with claim 8, characterised in that the low voltage lamp (10) is a cold light mirror lamp.

* * * * *